US005583315A

United States Patent [19]

Fleming

[11] Patent Number: 5,583,315

[45] Date of Patent: Dec. 10, 1996

[54] AMMONIUM NITRATE PROPELLANTS

[75] Inventor: Wayne C. Fleming, Glendale, Ariz.

[73] Assignee: Universal Propulsion Company, Inc., Phoenix, Ariz.

[21] Appl. No.: 183,711

[22] Filed: Jan. 19, 1994

[51] Int. Cl.[6] ..... C06B 45/10

[52] U.S. Cl. ..... 149/19.4; 149/19.5

[58] Field of Search ..... 149/19.4, 19.5

[56] References Cited

U.S. PATENT DOCUMENTS

| | | | |
|---|---|---|---|
| 3,711,344 | 1/1973 | Pierce | 149/19.4 |
| 3,793,100 | 2/1974 | Franabarger | 149/77 |
| 3,856,590 | 12/1974 | Kincaid et al. | 149/19.8 |
| 3,867,214 | 2/1975 | Zucker et al. | 149/100 |
| 3,954,528 | 5/1976 | Chang et al. | 149/19.4 |
| 3,956,890 | 5/1976 | Davis | 149/19.4 |
| 4,045,261 | 8/1977 | Baczuk | 149/19.4 |
| 4,061,511 | 12/1977 | Baczuk | 149/19.4 |
| 4,111,728 | 9/1978 | Ramnarace | 149/19.5 |
| 4,158,583 | 6/1979 | Frosch | 149/19.4 |
| 4,486,396 | 12/1984 | Kjøhl et al. | 423/265 |
| 4,591,399 | 5/1986 | van der Smissen et al. | 149/2 |
| 4,678,524 | 7/1987 | Cranney et al. | 149/21 |
| 4,689,097 | 8/1987 | Jones | 149/21 |
| 4,938,813 | 7/1990 | Eisele et al. | 149/19.4 |
| 5,062,365 | 11/1991 | Canterberry | 102/322 |
| 5,074,938 | 12/1991 | Chi | 149/19.4 |
| 5,271,778 | 12/1993 | Bradford et al. | 149/19.5 |

*Primary Examiner*—Edward A. Miller
*Attorney, Agent, or Firm*—Ellsworth R. Roston; Charles H. Schwartz

[57] ABSTRACT

A propellant with a long shelf life that is smoke-free when combusted. The propellant may have the following composition when the propellant includes a reinforcing agent.

| Material | Approximate Percentage Range by Weight |
|---|---|
| Ammonium nitrate | 40–85 |
| Binder (with curvative) | 4–40 |
| Energetic plasticizer | 0–40 |
| Reinforcing agent | 0.1–8 |

When the reinforcing agent is included in the propellant, a desiccant in the range of 0.02–6% may or may not be included in the propellant. The binder is selected from the group consisting of a thermoplastic material such as Finaprene® or Kraton® (e.g. thermoplastic elastomers) or a cure-hardening material or a combination thereof. Examples of the energetic plasticizer are trimethylolethane trinitrate, triethyleneglycol dinitrate, and butanetriol trinitrate. The desiccant may be a powdered molecular sieve which removes water from the propellant and increases the mechanical strength of the propellant. The reinforcing agent may be a nitrogen containing compound such as dicyandiamide or oxamide, increasing the mechanical strength and elasticity of the propellant. Alternately or in addition to the reinforcing agent, a time delay may be provided after the addition of the desiccant to the ammonium nitrate and before the mixing of the different ingredients with the ammonium nitrate. This delay also enhances the strength and elasticity of the propellant.

1 Claim, No Drawings

AMMONIUM NITRATE PROPELLANTS

This invention relates to propellants. More particularly, the invention relates to propellants having the properties of a long shelf life and a high strength and elasticity and of being smoke-free when combusted. The invention also relates to a method of forming such propellants.

In military tactical situations, a trail of smoke following a rocket-powered vehicle will allow a prospective adversary to be warned of an incoming threat and to track the vehicle for launching countermeasures. Furthermore, a puff of smoke at the launch position of the rocket-powered vehicle will allow a prospective adversary to discern the launch position and take appropriate countermeasures against the personnel and equipment at the launch position.

The smoke can be of two (2) types. The first type is provided by solid particles in the effluent of the rocket motor. Such smoke is termed "primary smoke". The other type is formed by reaction of a gaseous effluent such as hydrogen chloride with moisture in the air, resulting in a liquid/gas aerosol. Such smoke is termed "secondary smoke". Either type can result in tactical countermeasures.

To reduce the smoke to an acceptable minimum, propellants based on a mixture of nitroglycerine and nitrocellulose (known as "double base") and other ingredients have generally been used throughout the twentieth century. In addition, so-called "cross linked" double-base propellants have been developed so that the resultant propellant has been able to be cast into large "grains". This has provided the opportunity to add additional explosive materials such as RDX and HMX to the propellant to increase the energy of the propellant.

Unfortunately the propellants discussed in the previous paragraph have caused the sensitivity to increase in what was previously an already very sensitive propellant. For example, a survey of United States naval ships lost in combat from the American Revolution through the Korean War has resulted in a surprising conclusion. This surprising conclusion has shown that more than eighty percent (80%) of such ships were lost not through direct actions of enemy fire but as a result of unexpected and uncontrolled detonations of their own ammunition. Such ships include the Bon Homme Richard and the U.S.S. Arizona.

Even as late as the Vietnam War, an unexpected and uncontrolled detonation occurred on the U.S.S. Forrestal. Furthermore, the United States Air Force has found that detonable rocket motors stored near airfields have presented intractable storage problems because of the possibility of unexpected and uncontrolled detonations. This has been especially true in the European theater of operations.

The U.S. Department of Defense has accordingly decreed that all new ammunition will have to meet a plurality of criteria designated as "Insensitive Munitions Requirements". As a result, a significant effort has been made over the last several years to provide propellants which are non-detonable and are smokeless but which have sufficient energy and burning rate to make them operational and usable.

The U.S. Army Missile Command has produced such propellants. They are based upon the use of ammonium nitrate as an oxidizer and a low density polymer as the matrix or binder with nitrate esters as an energetic plasticizer. Such new propellants are smokeless and non-detonable and have sufficient energy and burning rates for many uses. However, ammonium nitrate propellants have a significant history of a limited shelf and service life of only approximately one (1) to two (2) years.

The short shelf and service life of ammonium nitrate propellants is in contradistinction to the shelf and service life of approximately ten (10) to twenty (20) years for propellants that do not include ammonium nitrate. This shelf life of approximately one (1) to two (2) years for ammonium nitrate propellants is not very long when it is considered that the military requirements for most tactical systems are approximately seven (7) years to ten (10) years.

The short shelf and service life of ammonium nitrate propellants result from crystal phase changes in the ammonium nitrate. These crystal phase changes cause changes in the density, and thus the physical size, of the particles in ammonium nitrate. These transformations occur at the following approximate temperatures: −18° C., 32.3° C., 84° C. and 125° C.

If all of the transformations always occur, the matrix of the propellant will wear out physically and the normally weak bonding between the propellant matrix and the ammonium nitrate crystals will be broken. This will cause a reduction in the strength and elastic deformation, or elongation, of the propellant. Cracks and unbonded areas in the propellant then develop with destructive results. These destructive results may include ballistic problems resulting in deflagration, explosion or detonation.

Of the changes discussed in the previous paragraph, the greatest changes in density occur at the 32.3° C. and 84.1° C. transitions. Unfortunately, these are also the transitions that occur most frequently in both the storage and service life of a typical rocket motor. Fortunately, however, the changes in density of these two (2) transformations are in opposite directions. Furthermore, the change in density at approximately 32.3° C. is inhibited by an anhydrous condition of the ammonium nitrate. Thus, if this change can be prevented by making the ammonium nitrate anhydrous, a propellant with a long shelf and service life, with smokeless properties and a high amount of energy when combusted should be attained.

A significant amount of research has been conducted under the Insensitive Munitions Program to stabilize the phase of ammonium nitrate. This research has been only partially successful even assuming that the ammonium nitrate and the propellant are kept dry during their lifetime. Furthermore, some of the materials added to the propellant as a result of the research have produced smoke and others have been carcinogenic.

Applicants' assignee has developed in the past propellants incorporating, in addition to ammonium nitrate, chemical components such as a carboxyl-terminated polybutadiene matrix. These materials are not suitable for use in propellants providing a minimal smoke when combusted. However, these propellants have exhibited a storage and service life for a period of more than seven (7) years without any detectable change.

Applicants have recently appreciated, in evaluating the propellants discussed in the previous paragraph, that a desiccant designated as a "molecular sieve" was incorporated in the propellants prior to the steps of reducing the size of the ammonium nitrate particles and mixing the different chemical components in the propellants. Molecular sieves are well known materials of the zeolite type. They are useful as scavengers of gases and water in propellants. As a scavenger of moisture, the molecular sieve aids the grinding, conveying and other steps in which dry ingredients are to be incorporated into propellants.

In spite of the use of desiccants such as molecular sieves in the types of propellants which produce smoke when combusted, no one has foreseen or suggested the use of such desiccants in propellants which are smoke-free when combusted. Applicants have recently incorporated small amounts of a desiccant such as a molecular sieve in propellants which are smoke-free when combusted and applicants have tested such propellants. These tests have indicated startling improvements in the characteristics of such propellants.

Examination of the smoke-free propellants discussed in the previous paragraph has shown that the desiccant such as a molecular sieve has protected the ammonium nitrate crystals from moisture. Furthermore, the tests have shown that the desiccant such as the molecular sieve has been surprisingly capable of removing significant quantities of water from the ammonium nitrate crystals which have been previously dried. This has occurred even though the amount of the desiccant such as the molecular sieve in the propellant has been relatively small.

The removal of the water from the interior of the ammonium nitrate crystals in smoke-free propellants has surprisingly solved the problem of a short shelf life that has been intractable for decades. It is also surprising how little has been the amount of the desiccant such as the molecular sieve that has had to be added to the ammonium nitrate to significantly increase the shelf and service life of the smoke-free propellants while maintaining the smoke-free characteristics and the high energy level of the propellants.

The addition of a desiccant such as a molecular sieve to propellants incorporating ammonium nitrate has been disclosed and claimed in co-pending application Ser. No. 08/553,771 filed on Apr. 28, 1993, in the names of Wayne C. Fleming, Hugh J. McSpadden and Donald E. Olander and assigned of record to the assignee of record of this application. However, although the shelf life of the propellant has been considerably increased, the strength and elasticity of the propellant are still lower than desired.

This invention provides additional improvements in the propellant, and in the method of producing the propellant, to increase the strength and elasticity of the propellant. The improvement in the propellant involves the addition of a reinforcing agent such as dicyandiamide or oxamide to the propellant. The improvement in the method alternately involves a delay in the mixing of the other ingredients with the ammonium nitrate after the desiccant or sieve has been added to the ammonium nitrate. It will be appreciated that both improvements may be incorporated with additional increases in the strength and elasticity of the propellant.

The propellant constituting this invention may include the following chemical components in the following percentages by weight when the propellant includes a reinforcing agent.

| Chemical Component | Approximate Relative Percentages by Weight |
|---|---|
| Ammonium Nitrate | Forty (40) to Eighty Five (85) |
| Binder (with curative) | Four (4) to Forty (40) |
| Energetic Plasticizer | Zero (0) to Forty (40) |
| Reinforcing agent | One tenth (0.1) to Eight (8) |

When the reinforcing agent is included in the propellant, a desiccant in the range of 0.02–6% may or may not be included in the propellant.

The binder in the propellant may be a cure-hardening material or a thermoplastic material such as Finaprene® or Kraton® (e.g. thermoplastic elastomers) or a combination of both a cure-hardening and a thermoplastic material. The binder may be selected from the group consisting of a hydroxy-terminated (but not a carboxy-terminated) butadiene, a polyglycol adipate, a thermoplastic material such as Finaprene® or Kraton® or from a mixture of these materials. Other polyhydroxyl polymers such as a glycidyl azide polymer may also be used.

The curative may be a polyfunctional isocyanate. Particular examples of a polyfunctional isocyanate are a diisocyanate, isophorone diisocyanate (IPDI), a triisocyanate, a higher isocyanate than a triisocyanate and "Desmodur N-100®" (a polyfunctional isocyanate) or a mixture of these ingredients. The energetic plasticizer may be selected from a group of nitrogen containing compounds. For example, the energetic plasticizer may be selected from the group consisting of trimethylolethane trinitrate, triethyleneglycol dinitrate and butanetriol trinitrate. The desiccant may be a powdered molecular sieve such as molecular sieve 4A. However, other desiccants such as molecular sieve 3A, 5A or 13X may also be used. The reinforcing agent may be a nitrogen containing compound such as dicyandiamide or oxamide.

A specific formulation of a propellant constituting this invention is as follows:

| Chemical Component | Relative Percentage by Weight |
|---|---|
| Polyglycol adipate | 6.12 |
| Trimethylolethane trinitrate | 11.00 |
| Triethyleneglycol dinitrate | 11.00 |
| N-methyl-4-nitroaniline | 0.37 |
| Trifunctional isocyanate | 1.32 |
| Carbon black | 2.00 |
| Ammonium nitrate | 67.97 |
| Molecular sieve 4A | 0.22 |

In the above propellant, the N-methyl-4-nitroaniline serves as a nitroplasticizer stabilizer and the carbon black serves as an opacifier.

The desiccant removes water from the propellant and increases the mechanical strength of the propellant. The reinforcing agent links to other ingredients in the propellant and increases the mechanical strength and elasticity of the propellant. Alternately or in addition to the reinforcing agent a time delay may be provided after the addition of the desiccant to the ammonium nitrate and before the mixture of the different ingredients in the ammonium nitrate. This delay also enhances the strength and elasticity of the propellant. When either the reinforcing agent is added or the time delay is provided, the strength and elasticity of the propellant are increased by a factor of approximately two (2). When both the reinforcing agent is added and the time delay is provided, the strength and elasticity of the propellant are increased by approximately another twenty percent (20%) to thirty percent (30%).

Another specific formulation of a propellant constituting this invention is as follows:

| Chemical Component | Relative Percentage by Weight |
|---|---|
| Polyglycol adipate | 6.12 |
| Trimethyolethane trinitrate | 11.00 |
| Carbon black | 2.00 |
| Triethyleneglycol dinitrate | 11.00 |
| N-methyl-4-nitroaniline | 0.37 |
| Ammonium nitrate | 63.97 |
| Trifunctional isocyanate | 1.32 |
| Molecular sieve 4A | 0.22 |
| Dicyandiamide | 4.00 |

As will be seen, both the molecular sieve and the dicyandiamide have been included in this propellant. Because of this, the time delay discussed in the subsequent paragraphs may also be provided to enhance the strength and elasticity of the propellant.

The dicyandiamide is an example of a nitrogen containing compound which may be used as the reinforcing agent. As an example of the improvement provided by the inclusion of the reinforcing agent in the propellant, the addition of four percent of dicyandiamide to the propellant more than doubled the tensile strength of the propellant while also significantly increasing the strain capability (elongation) of the propellant. This increase in tensile strength and strain capability may result from a polyurea bonding between the isocyanate and the dicyandiamide. This is different from the polyurethane bonding produced between the hydroxyl ion and the isocyanate.

It has been found that the strength and elasticity of the propellant are also significantly increased when there is a delay after the addition of the desiccant to the ammonium nitrate and before the addition of the other ingredients to the ammonium nitrate to form the propellant. Specifically, the desiccant may be mixed with the ammonium nitrate prior to grinding the ammonium nitrate. The ammonium nitrate may be reduced in size as by ball milling, "Micropulverizing" (hammer-mill) or "Fluid Energy Milling". The ground mixture of the desiccant and the ammonium nitrate may then be mixed with the other chemical components in the propellant except for the isocyanate. After an appropriate waiting time, the isocyanate may be added.

The increase in strength and elasticity of the propellant with different delays in time for the addition of the isocyanate may be seen from the following table:

| Time (hours) | 0 | 2 | 48 |
|---|---|---|---|
| Hardness (Shore A) | nil | 73 | 74 |
| Ultimate tensile strength (psi) | nil | 117 | 169 |
| Elongation at Break (%) | nil | 21 | 28 |

Elongation is an indication of elasticity. It indicates the distance through which the propellant can be stretched before it breaks. Qualities such as hardness, ultimate tensile strength and elasticity are important in preventing the propellant from cracking or breaking. When a propellant cracks or breaks, its surface area increases. This increases the tendency of the propellant to deflagrate, explode or detonate at undesired times. As will be appreciated, if a propellant deflagrates, explodes or detonates, it may injure people and damage property. An increase in the elasticity of the propellant is also desirable because it allows the propellant to expand in a confined space as the propellant burns. Such expansion of the propellant is desirable since the propellant might otherwise fragment in the empty space. Any such fragmentation would increase the tendency of the propellant to deflagrate, explode or detonate.

A specific formulation of a propellant providing an enhanced strength and elongation by a time delay is as follows:

| Chemical Component | Relative Percentage by Weight |
|---|---|
| Polyglycol adipate | 6.12 |
| Trimethylolethane trinitrate | 11.00 |
| Triethyleneglycol dinitrate | 11.00 |
| N-methyl-4-nitroaniline | 0.37 |
| Trifunctional isocyanate | 1.32 |
| Carbon black | 2.00 |
| Ammonium nitrate | 63.97 |
| Molecular sieve 4A | 0.22 |
| Dicyandiamide | 4.00 |

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination in a propellant having properties of a long shelf life and of being smoke free when combusted,

| Material | Approximate Relative Percentage by Weight |
|---|---|
| Polyglycol adipate | 6.12 |
| Trimethylolethane trinitrate | 11.00 |
| Carbon black | 2.00 |
| Triethyleneglycol dinitrate | 11.00 |
| Trifunctional isocyanate | 1.32 |
| N-methyl-4-nitroanoline | 0.37 |
| Ammonium nitrate | 63.97 |
| Molecular sieve 4A | 0.22 |
| Dicyandiamide | 4.00 |

* * * * *